US007153201B2

(12) United States Patent
Smith

(10) Patent No.: US 7,153,201 B2
(45) Date of Patent: Dec. 26, 2006

(54) OVAL SHARPENING ROD HAVING INTERRUPTED DIAMOND COATED SURFACE AND PROCESS OF MANUFACTURING SAME

(75) Inventor: Richard S Smith, Hot Springs, AR (US)

(73) Assignee: Smith Abrasives, Inc., Hot Springs, AR (US)

( * ) Notice: Subject to any disclaimer, the term of this patent is extended or adjusted under 35 U.S.C. 154(b) by 305 days.

(21) Appl. No.: 10/888,851

(22) Filed: Jul. 12, 2004

(65) Prior Publication Data

US 2006/0009141 A1 Jan. 12, 2006

(51) Int. Cl.
*B24B 3/36* (2006.01)

(52) U.S. Cl. ..... 451/540; 76/81.8; 76/84

(58) Field of Classification Search ..... 451/321, 451/319, 312, 540, 552, 557; 76/81, 81.8, 76/82, 84
See application file for complete search history.

(56) References Cited

U.S. PATENT DOCUMENTS 1,866,384 A * 7/1932 Abranathy ..... 76/81
5,458,534 A * 10/1995 Campione et al. ..... 451/555
5,611,326 A * 3/1997 Caspani et al. ..... 125/39
6,151,991 A * 11/2000 Seville ..... 76/82

* cited by examiner

*Primary Examiner*—Jacob K. Ackun, Jr.
(74) *Attorney, Agent, or Firm*—Edward D. Gilhooly

(57) ABSTRACT

An oval rod sharpener having an interrupted diamond abrasive surface having plurality of holes forming wells for collecting filings during sharpening. The abrasive surface is formed by multiple layers of micron sized diamonds, such as monocrystalline diamonds. A plastic pad is provided on the tip end of the oval abrasive rod to protect a support surface on which the sharpener rests during a sharpening operation.

12 Claims, 3 Drawing Sheets

OVAL SHARPENING ROD HAVING INTERRUPTED DIAMOND COATED SURFACE AND PROCESS OF MANUFACTURING SAME

BACKGROUND OF THE INVENTION

1. Field of the Invention

The invention relates in general to knife and tool sharpeners and more particularly, to an oval abrasive rod having an interrupted diamond coated sharpening surface.

2. Summary of the Prior Art

Many designs of hand held knife and tool sharpeners have long been present in the marketplace. One type of sharpener that provides a superior sharpening effect utilizes a diamond coated abrasive surface. Many prior diamond coated sharpeners possess a continuous, uninterrupted sharpening surface. During the sharpening process using a continuous diamond abrasive, metal filings build up on the surface requiring frequent cleaning. A continuous abrasive surface in the prior art is also incapable of delivering optimum honing and realigning of the cutting edge being sharpened.

Recently, diamond sharpening stones have been introduced having a flat diamond interrupted surface to attain superior results over a continuous flat surface. None of these designs for an interrupted diamond surface are provided on a continuous curved surface, on which optimum sharpening results can be attained. Accordingly, it is desirable in the prior art to provide a curved interrupted diamond sharpening surface for sharpening edges.

SUMMARY OF THE INVENTION

It is therefore an objective of the invention to provide an improved knife and tool sharpener and process of manufacture wherein the invention has an oval rod formed with an exterior interrupted diamond surface. The abrasive rod herein disclosed is provided with a unique interrupted hole pattern attaining sharpening results that can not be duplicated by diamond coated sharpening steels having a continuous abrasive surface as provided in the prior art. The oval shape of the abrasive rod allows uniform blade contact with the abrasive surface during the entire sharpening stroke. The plastic tip of the oval rod of the invention prevents scratching of the support surface bearing the sharpener during use, such as a counter and the like. The pattern of the interrupted overlapping holes aids in speeding up the sharpening process by holding and collecting the metal filings, which ordinary accumulate on the abrasive surface during the sharpening process. The abrasive surface of the invention herein is coated with multiple layers of micron-sized diamonds, such as monocrytalline diamonds, the hardest known material. The oval diamond abrasive rod herein disclosed provides a highly effective and easy to use implement for improved sharpening results.

DESCRIPTION OF THE PREFERRED EMBODIMENT

Figure 1:
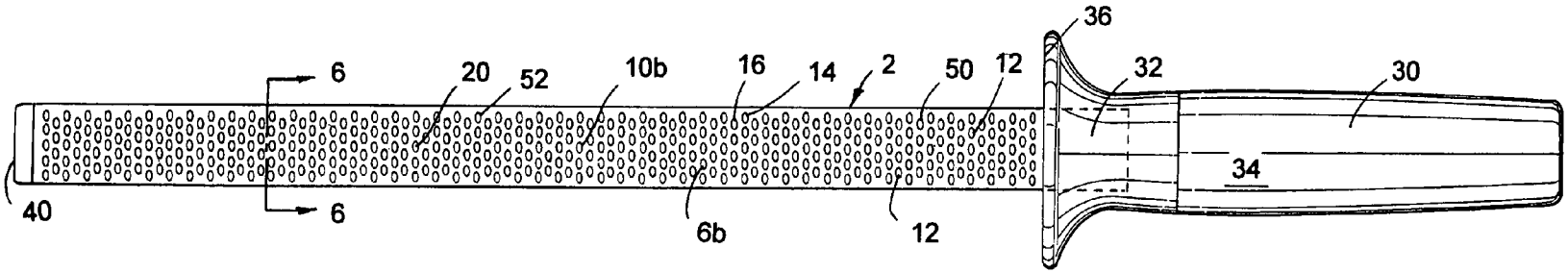
FIG. 1 is a top plan view of the oval sharpening rod having an interrupted abrasive diamond surface of the invention.
Figure 2:
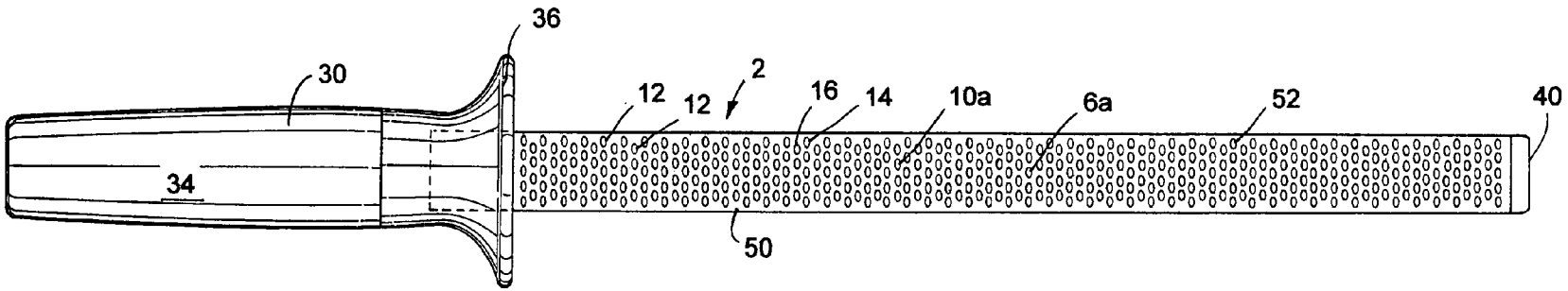
FIG. 2 is a bottom plan view of the oval sharpening rod of FIG. 1.
Figure 3:
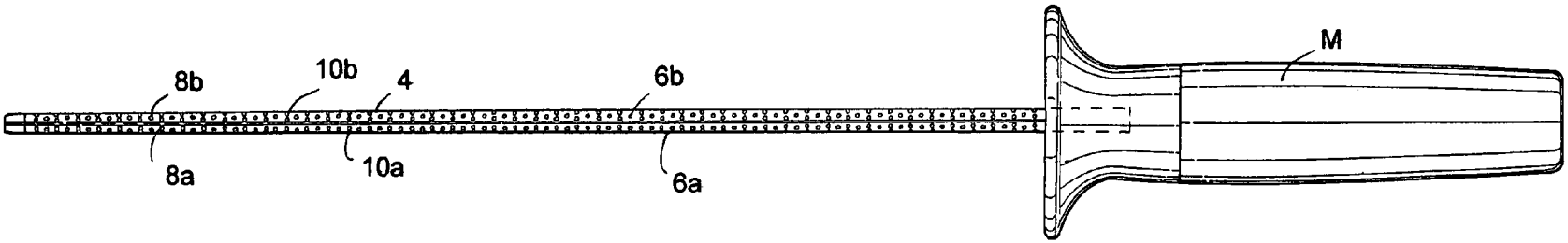
FIG. 3 is a side elevational view of the oval sharpening rod of FIG. 1.
Figure 4:
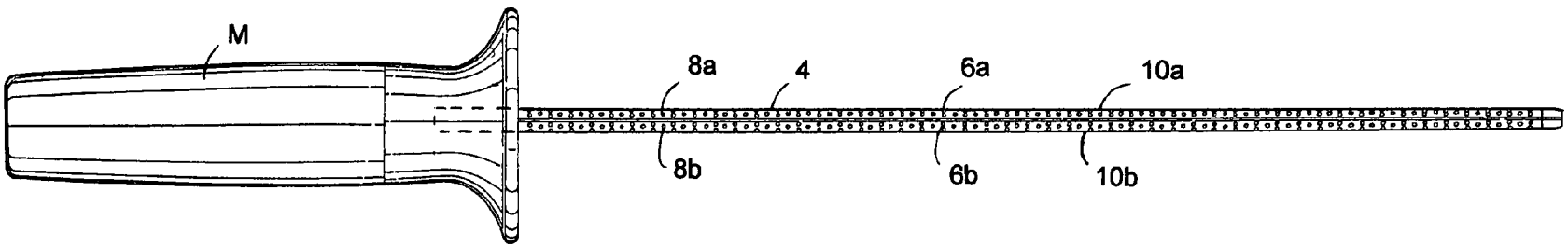
FIG. 4 is a side elevational view of the oval sharpening rod of FIG. 1 opposite to FIG. 3.
Figure 7:
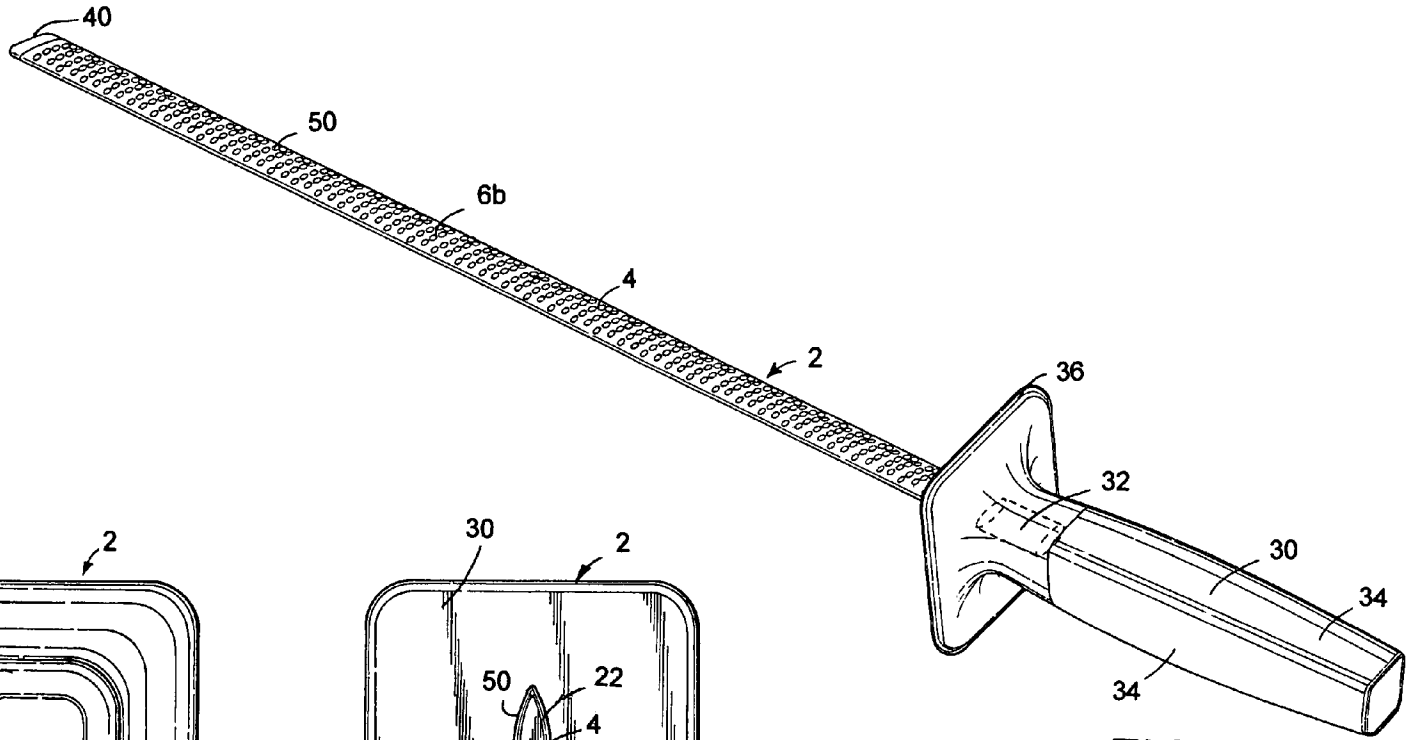
FIG. 7 is a side perspective view of the oval sharpening rod of FIG. 1.
Figure 6:
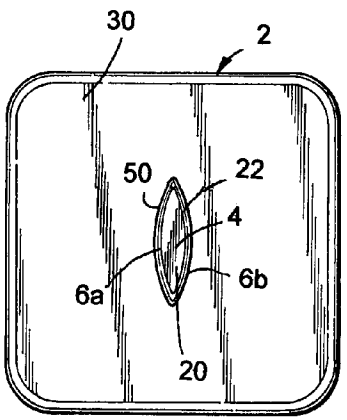
FIG. 6 is a front sectunal view from the tip end of the oval sharpening rod taken along lines 6—6 of FIG. 1.
Figure 5:
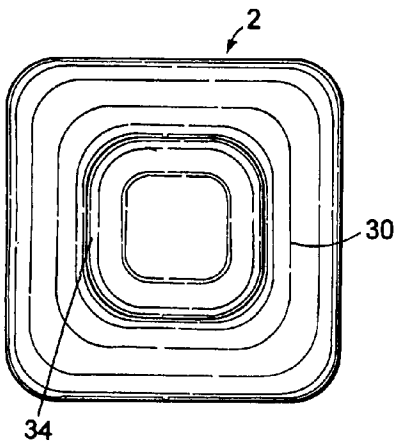
FIG. 5 is a rear elevational view from the handle end of the oval sharpening rod of FIG. 1.

Referring now to FIGS. 1–7, there is illustrated the oval sharpening rod of the invention having an interrupted diamond coated abrasive surface, generally designated by reference numeral 2. The oval sharpening rod 2 includes an abrasive rod 4 having an oval cross section (see FIG. 6). The abrasive rod 4 is formed from two matching oval half portions or shells 6*a*, 6*b*, which are welded together along their longitudinal edges 8*a*, 8*b* to form the unitary oval rod 4 having outer surfaces 10*a* and 10*b*. The oval rod sections 6*a* and 6*b* each have a plurality of stamped holes 12 extending along the longitudinal axis of the exposed end portion 4' of the oval rod 4. The holes 12 are disposed in a pattern of a plurality of lateral parallel rows 14 and 16 each having a plurality of holes 12 in each row. As best seen in FIGS. 1 and 2, the holes 12 in rows 14 extend closer to formed edges 8*a*, 8*b* than do the holes 12 in row 16. Although the holes 12 may be formed in other shapes if desired, the holes 12 are shown as being oval in cross section of equal size. As best seen in FIG. 6, a plastic core 20 is injected into the cavity 22 formed in oval rod 4 along its length. As a result, plastic is a present in each of the holes 12. A handle 30 is formed over an end portion 32 of oval rod 4 for securement. The handle 30 has a gripping surface formed by four generally flat exterior surfaces 34. The handle 30 is formed with an enlarged guard 36 as protection to the user of the sharpener. A plastic pad 40 is formed on the tip end 4'of abrasive rod 4 to protect any surface from damage on which the oval sharpener rod is supported during sharpening of a knife, tool and the like.

Multiple layers 50 of micron-sized diamonds are coated along the entire length of the exposed surface 10*a* and 10*b* to provide an abrasive sharpening surface extending circumferentially around the rod generally along the length of rod 4. Although any suitable diamonds coatings may be employed, monocrystalline diamonds are highly effective in use. The multiple layers 50 are not applied to the plastic in holes 16 and thus the diamond layers 50 form wells 52 in the holes 16. The wells 52 formed in the overlapping holes 16 thus collect and hold the metal filings during the sharpening process to allow the abrasive surface to remain clean and increase the speed and efficiency of the sharpening process.

In the process of manufacturing the oval sharpening rod 2 of the invention, two identical flat steel blanks (not shown) are stamped with the overlapping pattern of holes 12 as previously described. After stamping, the two blanks are mechanically formed to create the two oval half portions 6*a*, 6*b*. These two mirror image portions 6*a*, 6*b* are welded along their longitudinal 8*a*, 8*b* edges to create the unitary oval rod 4. A plastic is then injected by a conventional process into the interior cavity formed by the welded oval rod 4 filling the interior of the rod until plastic comes out of the holes 12. The outer surface of the rod is then ground so the outer surface of the steel of the rod 4 and the plastic in holes 12 are flat and at the same level to form a uniform surface. The multiple layers 50 of diamond abrasive layers are then applied to the outer surface 10*a*, 10*b* which layers build up on the steel and create wells 52, since the abrasive layers 50 will not adhere to the plastic in holes 12. As stated previously, the well 52 create a place for the metal filings to collect during the sharpening process, which allows the abrasive surface to remain clean and thus speeds up the sharpening process.

What is claimed is:

1. An oval sharpening rod comprising an oval rod having an outer surface and a plurality of rows of holes, each of said rows having a plurality of holes, said oval rod having an interior cavity filled with a plastic core, said plastic core extending through said plurality of holes, handle means affixed to an end portion of said oval rod, and at least one layer of a diamond abrasive being coated on said outer surface and forming an open well around said plurality of rows of stamped holes.

2. The oval sharpening rod according to claim 1 wherein said plastic in said holes and said outer surface beneath said at least one layer of a diamond abrasive form a level continuous surface.

3. The oval sharpening rod according to claim 1 wherein said oval rod includes a pair of identical half portions, said half portions having opposed edges being welded together along their lengths to form said cavity.

4. The oval sharpening rod according to claim 1 wherein said at least one layer of a diamond abrasive comprises a plurality of layers of monocrystalline diamonds.

5. The sharpening rod according to claim 1 wherein said sharpening rod has a free end for supporting said sharpening rod, said free end having a protective pad to protect a support surface.

6. The sharpening rod according to claim 1 wherein said plurality of rows are parallel to each other.

7. An oval sharpening rod comprising an oval rod having an outer surface and a plurality of rows of holes, said oval rod having a pair of half portions being welded together along their lengths, each of said rows having a plurality of holes, said oval rod having an interior cavity filled with a plastic core, said plastic core extending through said plurality of holes, handle means affixed to an end portion of said oval rod, and at least one layer of a diamond abrasive being coated on said outer surface.

8. The oval rod according to claim 1 wherein said at least one layer of diamond abrasive surrounds said plurality of holes to form wells.

9. The oval rod according to claim 1 wherein a plurality of layers of diamond abrasive is applied to said outer surface.

10. A process of manufacturing an oval abrasive rod having an interrupted diamond abrasive surface comprising the steps of providing a pair of flat metal blanks, stamping a plurality of holes in said flat metal blanks, forming said pair of flat blanks into a pair of oval rod portions, welding said oval rod portions together along their length to provide a unitary metal oval rod having an interior cavity, injecting a core of plastic into said cavity and into said plurality of holes, and applying at least one layer of a diamond abrasive on the exterior surface of said metal oval rod in surrounding relationship to said plurality of holes.

11. The process according to claim 10 further comprising the step of grinding the surface of said rod after injection of said plastic to remove excess plastic to make said surface and said plastic level.

12. The process according to claim 11 further comprising the step of creating a well in said plurality of holes after applying at least one layer of a diamond abrasive around said plurality of holes.

* * * * *